US009427037B1

(12) United States Patent
Atherton

(10) Patent No.: US 9,427,037 B1
(45) Date of Patent: Aug. 30, 2016

(54) CLIP FOR FABRIC AND METHOD OF USE

(71) Applicant: Debra Ann Atherton, Tampa, FL (US)

(72) Inventor: Debra Ann Atherton, Tampa, FL (US)

( * ) Notice: Subject to any disclaimer, the term of this patent is extended or adjusted under 35 U.S.C. 154(b) by 170 days.

(21) Appl. No.: 14/186,383

(22) Filed: Feb. 21, 2014

Related U.S. Application Data

(60) Provisional application No. 61/850,912, filed on Feb. 26, 2013.

(51) Int. Cl.
*A41H 37/00* (2006.01)
*A41F 1/00* (2006.01)

(52) U.S. Cl.
CPC ..... *A41H 37/00* (2013.01); *A41F 1/00* (2013.01)

(58) Field of Classification Search
CPC ..... A44B 99/00; A44B 15/005; D06F 55/02; Y10T 24/1394; Y10T 24/44291; Y10T 24/4447; Y10T 24/44419; Y10T 24/44444; Y10T 24/44752; Y10T 24/44872; Y10T 24/1391; Y10T 24/1404; Y10T 24/3428; Y10T 24/3429; Y10T 24/3435; Y10T 24/3456; Y10T 24/346; Y10T 24/3464; Y10T 24/44274; Y10T 24/44393; Y10T 24/44427; Y10T 24/44462; Y10T 24/44479; Y10T 24/44513; Y10T 24/44521; Y10T 24/4453; Y10T 24/44564; Y10T 24/44701; Y10T 24/44906; Y10T 24/44915; Y10T 24/44932; Y10T 24/4494; A41F 3/02; A41F 11/06; A41F 15/02; A41F 1/00; A45F 5/02; A45F 5/004; A45F 5/021; A47G 25/485; A47G 25/005; B42F 1/006; A44C 3/001; A45C 13/001; A45C 13/08; A45C 15/00; A45C 3/04; A47F 5/0006; A61J 17/00
USPC ..... 24/3.12, 18, 327, 332, 351, 354, 487, 24/489, 501, 505, 507, 509, 510, 511, 543, 24/557
See application file for complete search history.

(56) References Cited

U.S. PATENT DOCUMENTS 1,358,560 A * 11/1920 Kennison ..... A44B 6/00 24/507
1,782,057 A * 11/1930 Bollinger ..... A41F 19/005 2/323
2,583,784 A * 1/1952 MacCaferri ..... A47G 25/485 223/91
3,054,201 A * 9/1962 Burns ..... G09F 3/16 40/1.5
3,531,835 A * 10/1970 Paikin ..... A41F 1/00 24/516
3,914,828 A * 10/1975 Noda ..... A41F 3/02 24/489
3,956,805 A * 5/1976 Stroh ..... A41F 15/02 24/332
4,005,510 A * 2/1977 Noda ..... A41F 3/02 24/489
4,616,113 A * 10/1986 Jank ..... G08B 13/1463 200/61.13
4,807,334 A * 2/1989 Blanchard ..... A44B 99/00 223/91

(Continued)

*Primary Examiner* — Robert J Sandy
*Assistant Examiner* — David Upchurch
(74) *Attorney, Agent, or Firm* — Ted Masters

(57) ABSTRACT

A clip for fabric includes a pair of pivotally connected jaws which can be opened to accept fabric and closed to grip the fabric. The distal ends of the jaws combine to form a ratchet which allows the jaws to be closed, but once engaged prevents the jaws from re-opening. The proximal ends of the jaws form a spreading mechanism which causes the proximal ends of the jaws to spread apart as the clip clamps down on the fabric. This spreading action results in an even distribution of pressure upon the fabric.

21 Claims, 9 Drawing Sheets

(56) References Cited

U.S. PATENT DOCUMENTS 4,847,956 A * 7/1989 Levine ..... B65D 33/1675 24/30.5 R
5,148,581 A * 9/1992 Hartmann ..... A44B 99/00 16/4
5,366,458 A * 11/1994 Korthoff ..... F16B 2/22 606/151
5,402,558 A * 4/1995 Santapa ..... A47G 25/485 223/91
5,462,555 A * 10/1995 Bolanos ..... A61B 17/122 606/120
5,640,742 A * 6/1997 White ..... A44C 3/001 24/18
5,655,270 A * 8/1997 Boisvert ..... A45F 5/02 24/301
5,732,921 A * 3/1998 Lemire ..... A47F 5/0006 24/515
5,948,003 A * 9/1999 Shefflin ..... A61J 17/00 606/234
6,101,689 A * 8/2000 Jo ..... A45F 5/02 24/332
6,298,526 B1 * 10/2001 Baumdicker ..... A44B 99/00 24/306
6,754,937 B1 * 6/2004 Martin ..... B42F 1/006 24/351
7,428,771 B2 * 9/2008 Fujii ..... A61J 1/2093 24/30.5 R
2004/0250385 A1 * 12/2004 Folkmar ..... A44B 99/00 24/543
2005/0257353 A1 * 11/2005 Rohrig ..... A45F 5/02 24/537
2006/0236506 A1 * 10/2006 Farchione ..... A45F 5/004 24/3.12
2007/0075104 A1 * 4/2007 Yau ..... A47G 25/485 223/85
2007/0193211 A1 * 8/2007 Harrison ..... A45C 13/08 52/750
2009/0272397 A1 * 11/2009 Defenbaugh ..... A45D 8/20 132/277
2010/0031476 A1 * 2/2010 Coldiron ..... A44B 15/005 24/3.12
2013/0226200 A1 * 8/2013 Kappel ..... A61B 17/122 606/142
2013/0333167 A1 * 12/2013 Wu ..... F16B 2/10 24/517

* cited by examiner

Fig. 5
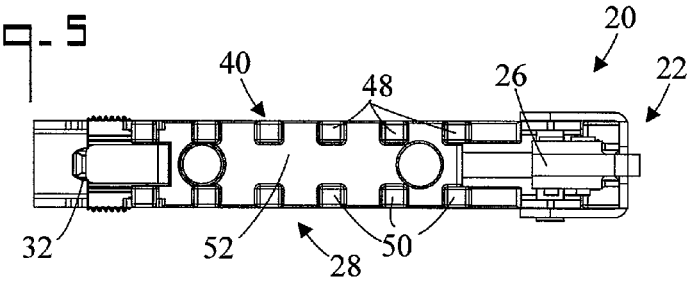
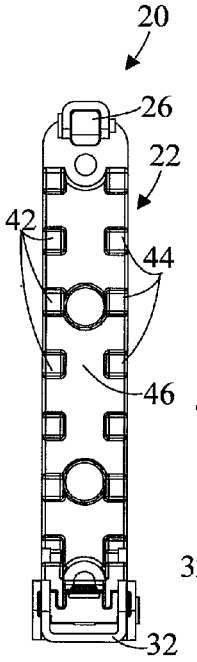
Fig. 8
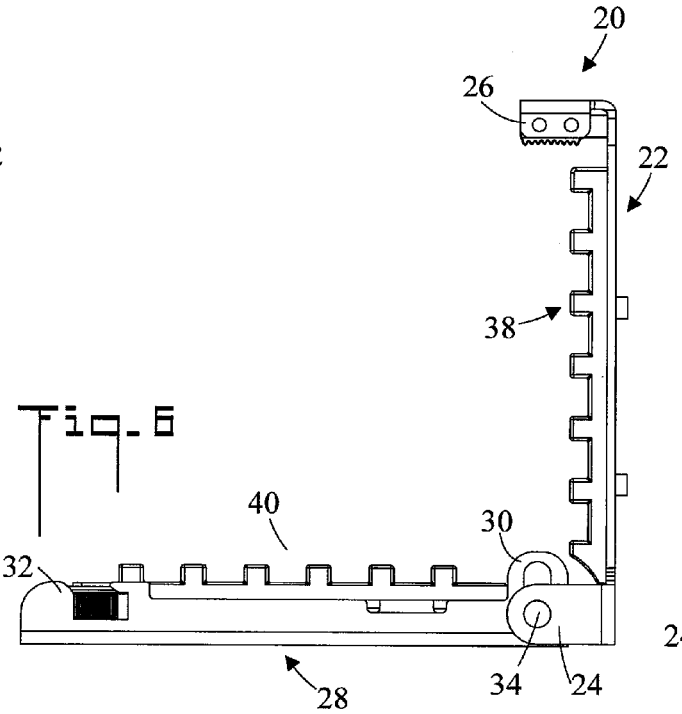
Fig. 6
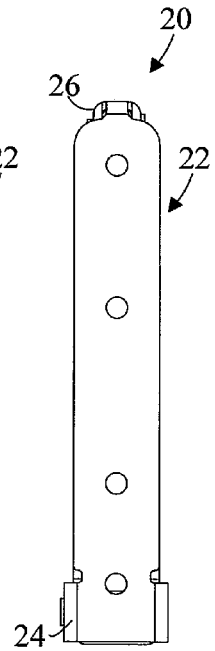
Fig. 9
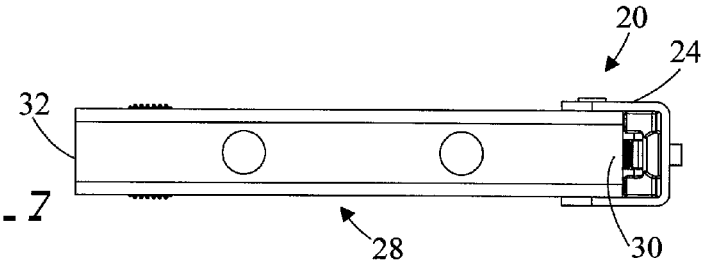
Fig. 7

Fig. 10
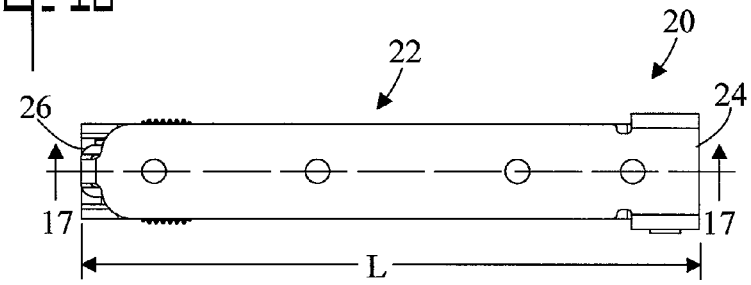
Fig. 11
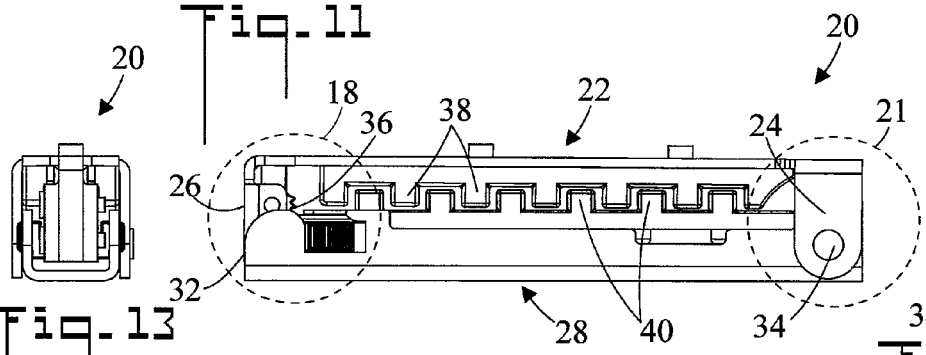
Fig. 13
Fig. 14
Fig. 12
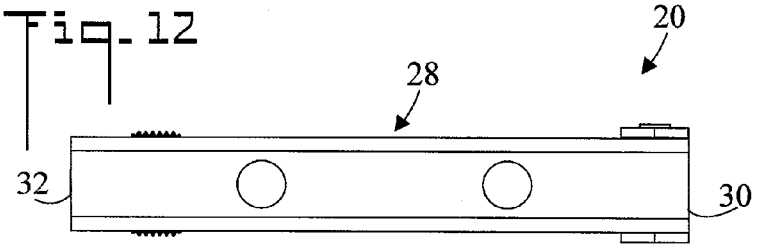

CLIP FOR FABRIC AND METHOD OF USE

CROSS REFERENCE TO RELATED APPLICATION

This application claims the filing benefit under 35 U.S.C. §119(e) of U.S. Provisional Application No. 61/850,912, filed Feb. 26, 2013, which is hereby incorporated by reference.

TECHNICAL FIELD

The present invention pertains generally to fabric, and more particularly to a clip for gripping the fabric in order to make alterations such as to a garment or other fabric article.

BACKGROUND OF THE INVENTION

The common method used for making an alteration to a garment or other fabric article is to use a needle and thread to alter the shape and size of the article. In the majority of these cases the alteration is permanent. A first problem arises when the alteration is either too tight, too loose, too short, too long or otherwise not to the satisfaction of the user. A second problem associated with the conventional method of alteration is the state of permanency that is made to the altered article. Once altered, the alteration cannot be undone and the article brought back to its original state without some sort of damage made by the needle and thread. To try and undo an alteration made to an article of fabric can be extremely difficult and more often then not impossible to repair because the article has already been modified/cut and/or damaged in the process of making the alteration. A third problem associated with the conventional method of alteration is the time and money spent in performing the alteration. Many users do not have the skill to make the alteration themselves, and as such must hire the services of a professional tailor.

BRIEF SUMMARY OF THE INVENTION

The present invention is directed to a clip which connects to a garment or other article of fabric by clamping layers of fabric together creating the alteration needed to provide the look, feel and fit desired by the user. Once installed, the clip has a quick release which gives the user the option to quickly undo and reverse any and all modifications, thereby bringing the garment or other article back to its original state. The clip provides the user with a useful option to the conventional 'needle and thread' method of tailoring/alterations for a vast majority of minor needed adjustments. Further, the clip will create a variety of angles, shapes and designs which will further compliment the garment or article, as well as give the user a means of quick and easy, convenient and affordable, non permanent tailoring/alterations options. The clip provides the ability to instantly alter or mend a garment or other fabric article without puncturing the fabric, as well as being able to instantly undo any and all modifications bringing the garment or other fabric article back to its original state. The clip can also add a decorative aspect to the garment or fabric for attractiveness.

For example, if a user buys a blouse at the store but later finds that it is a little too big in the waist . . . instead of taking the blouse to the tailors to have them perform minor alterations for a better fit . . . the user will be able to use the clip to pull the fabric together to create a similar adjustment that can be used on a temporary basis. In another example, a user is out for dinner and discovers a rip in her dress . . . the user can use the clip to pull the fabric together . . . therefore, covering up the rip. Of course, this fix is temporary, but will provide a convenient solution until permanent repair can be effected. The clip allows the user to make minor adjustments or repairs to a garment or other article of fabric without having to use a needle and thread. The clip provides a way to make temporary adjustments without puncturing the fabric, and which can be readily removed bringing the garment or other fabric article back to its original state.

The clip can be used on ladies shawls, wraps and scarves which often have to be used with a brooch/pin to keep the garment from coming off. The clip can also be used to make minor alterations to bedding, pillows cases, draperies and curtains. The clip provides an alternative that does not puncture the users garment/fabric. Any alterations for use on fabrics where the user does not wish to make permanent or have any type of puncture damage from needles and thread would apply.

The clip grips the fabric by clamping two or more layers of fabric together to create a 'dart like' closure for alteration. In an embodiment, the clip can have a decorative aspect which further compliments the garment or fabric and can be worn on-the-go and requires no skill to use.

Moreover, the clip comprises a "mending application" which enables the wearer to quickly resolve an alteration that needs immediate attention without damaging the fabric with a puncture from a needle or pin. The decorative appearance of the clip allows the wearer to go out in public without feeling or looking like they are covering up a rip or hole in the garment.

In accordance with an embodiment, a clip for fabric includes a first jaw which has a first end and an opposite second end, and a second jaw which has a first end and an opposite second end, the first end of the second jaw is pivotally connected to the first end of the first jaw. The first and second jaws are positionable to an open position and to a closed position. The first end of the first jaw and the first end of the second jaw form a spreading mechanism which causes the first end of the first jaw to spread apart from the first end of the second jaw. The second end of the first jaw and the second end of the second jaw form a ratchet which engages in the closed position and connects the second end of the first jaw to the second end of the second jaw.

In accordance with another embodiment, the spreading mechanism includes a biasing device which urges the first end of the first jaw and first end of the second jaw together.

In accordance with another embodiment, the spreading mechanism includes (1) the first end of the first jaw having a pivot pin, (2) the first end of the second jaw having a slot which receives the pivot pin, and (3) a biasing device which urges the first end of the first jaw and the first end of the second jaw together.

In accordance with another embodiment, the biasing device includes a leaf spring which is connected to the second jaw and abuts the pivot pin.

In accordance with another embodiment, when the fabric is placed between the first jaw and the second jaw and a closing force is applied to the second end of the first jaw and the second end of the second jaw, the fabric blocks closure of the first jaw with the second jaw thereby causing the first end of the first jaw to spread apart from the first end of the second jaw when the closing force is applied.

In accordance with another embodiment, the first jaw has a first plurality of teeth and the second jaw has a second plurality of teeth, the first plurality of teeth and the second plurality of teeth for gripping the fabric therebetween.

In accordance with another embodiment, the first plurality of teeth of the first jaw and the second plurality of teeth of the second jaw each are rectangular solids.

In accordance with another embodiment, the first plurality of teeth of the first jaw includes a first row of teeth and a second row of teeth are separated by a first cavity, and the second plurality of teeth of the second jaw includes a first row of teeth and a second row of teeth are separated by a second cavity.

In accordance with another embodiment, the ratchet includes one of the second end of the first jaw and the second end of the second jaw having a toothed member, and the other of the second end of the first jaw and the second end of the second jaw having a pawl which engages the toothed member when the first and second jaws are in the closed position.

In accordance with another embodiment, a pawl release disengages the pawl from the toothed member.

In accordance with another embodiment, the jaw may or may not have teeth.

Other embodiments, in addition to the embodiments enumerated above, will become apparent from the following detailed description, taken in conjunction with the accompanying drawings, which illustrate, by way of example, the principles of the clip and method of use.

BRIEF DESCRIPTION OF THE DRAWINGS

FIG. 5 is a top plan view of the clip in the open position;

FIG. 6 is a side elevation view of the clip in the open position;

FIG. 7 is a bottom plan view of the clip in the open position;

FIG. 8 is an end elevation view of the clip in the open position;

FIG. 9 is an opposite end elevation view of the clip in the open position;

FIG. 10 is a top plan view of the clip in the closed position;

FIG. 11 is a side elevation view of the clip in the closed position;

FIG. 12 is a bottom plan view of the clip in the closed position;

FIG. 13 is an end elevation view of the clip in the closed position;

FIG. 14 is an opposite end elevation view of the clip in the closed position;

DETAILED DESCRIPTION OF THE INVENTION

Figure 1:
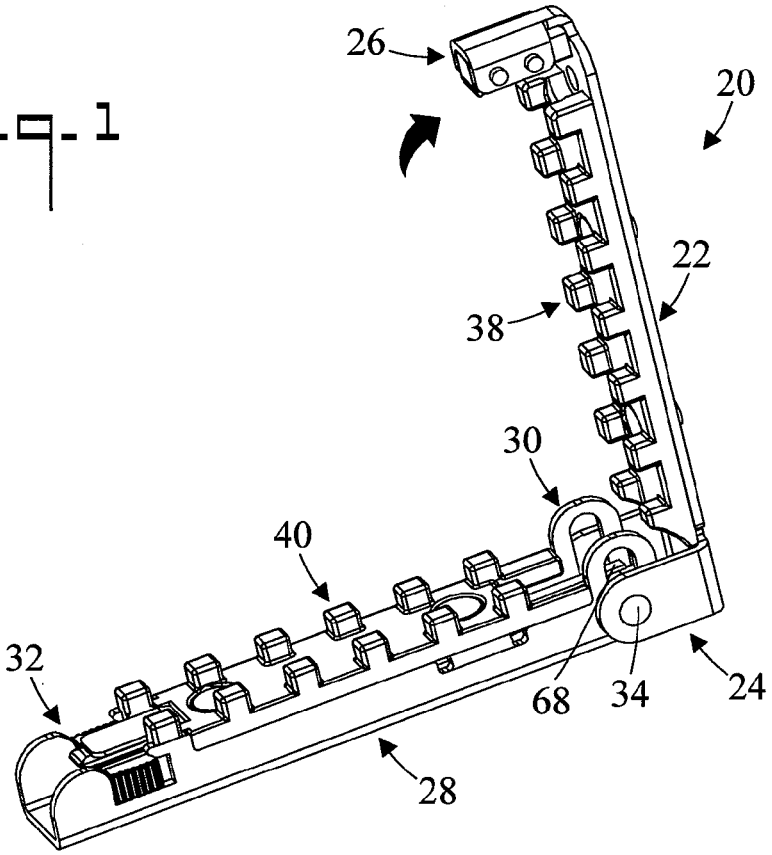
FIG. 1 is a perspective view of a clip for fabric shown in an open position.
Figure 2:
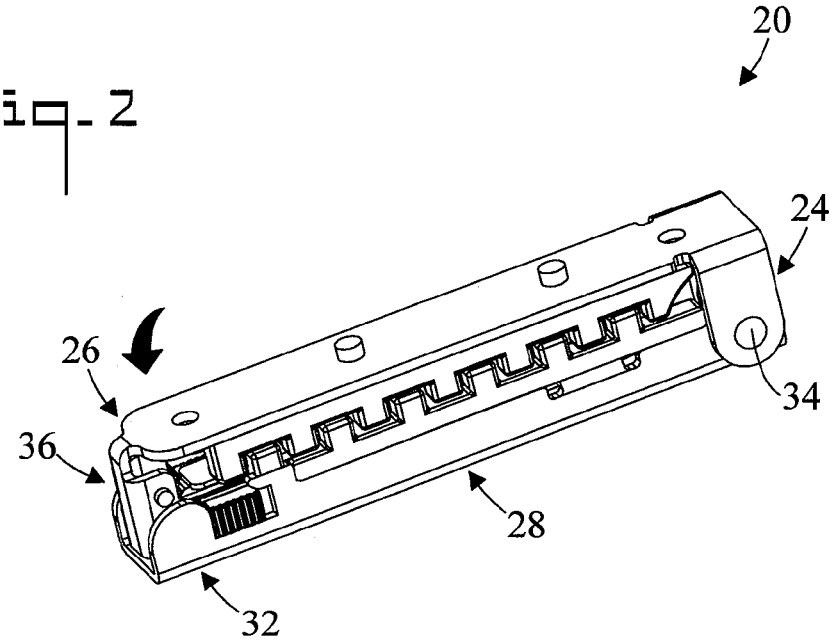
FIG. 2 is a perspective view of the clip shown in a closed position.
Figure 3:
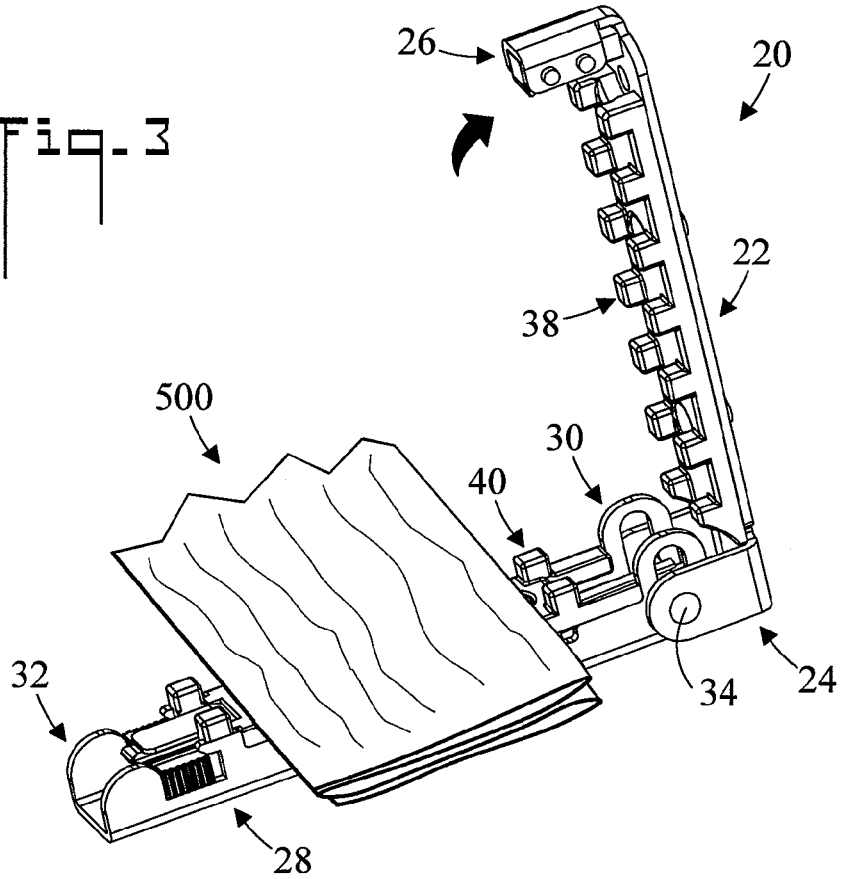
FIG. 3 is a perspective view of the clip in the open position with fabric placed between the jaws of the clip.
Figure 4:
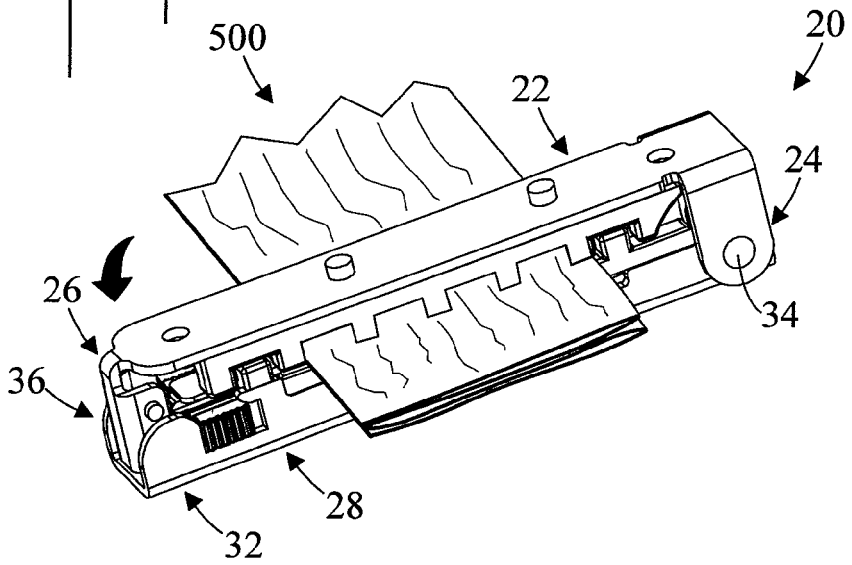
FIG. 4 is a perspective view of the clip with the jaws closed and gripping the fabric.

Referring initially to FIGS. 1-2 there are illustrated perspective views of a clip for fabric shown in open and closed positions respectively, the clip generally designated as 20. FIGS. 3 and 4 are perspective views of clip 20 in the open and closed positions respectively with clip 20 being used to grip fabric 500. Clip 20 includes a first jaw 22 having a first end 24 (proximal end) and an opposite second end 26 (distal end), and a second jaw 28 having a first end 30 (proximal end) and an opposite second end 32 (distal end). First end 30 of second jaw 28 is pivotally connected to first end 24 of first jaw 22 by a pivot pin 34, so that first 22 and second 28 jaws are selectively positionable to the open position of FIGS. 1 and 3 and to the closed position of FIGS. 2 and 4. Second end 26 of first jaw 22 and second end 32 of second jaw 28 combine to form a ratchet 36 (also refer to FIGS. 18-19) which engages in the closed position and connects second end 26 of first jaw 22 to said second end 32 of second jaw 28. That is, the jaws 22 and 28 are in the closed position when ratchet 36 is engaged. In an embodiment, first jaw 22 has a first plurality of teeth 38 and second jaw 28 has a second plurality of teeth 40. First plurality of teeth 38 and second plurality of teeth 40 are shaped and dimensioned to grip fabric 500 therebetween as is shown in FIG. 4. It is noted however, that in another embodiment first jaw 22 and second jaw 28 do not have teeth (refer to FIG. 28 and the associated discussion). As used herein the term "fabric" broadly means any cloth made of natural or synthetic material. In FIGS. 3 and 4 it is noted that multiple layers of fabric 500 are placed between jaws 22 and 28 of clip 20 (also refer to FIG. 20 and the associated discussion).

FIGS. 5-9 are top plan, side elevation, bottom plan, end elevation, and opposite end elevation views respectively of clip 20 in the open position showing first jaw 22 having first end 24 and second end 26, second jaw 28 having first end 30 and second end 32. First plurality of teeth 38 of first jaw 22 and second plurality of teeth 40 of second jaw 28 are each rectangular solids. That is, each tooth has six sides one of which is connected to a common tooth plate 41 (refer to FIG. 15). The teeth have rounded edges so as not to damage fabric 500 when it is gripped. Moreover, first plurality of teeth 38 of first jaw 22 includes a first row of teeth 42 and a second row of teeth 44 separated by a first cavity 46. Cavity 46 accepts fabric 500 as it is being gripped, and tends to reduce stress on the fabric. Similarly, second plurality of teeth 40 of second jaw 28 includes a first row of teeth 48 and a second row of teeth 50 separated by a second cavity 52. It is noted that in FIG. 6, the opposite side is the mirror image of that shown.

Figure 20:
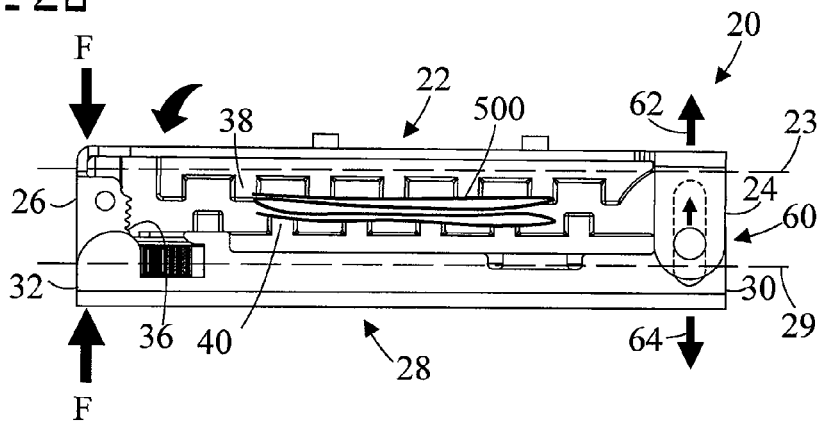
FIG. 20 is a side elevation view showing the clip gripping the fabric.

FIGS. 10-14 are top plan, side elevation, bottom plan, end elevation, and opposite end elevation views respectively of clip 20 in the closed position. It is noted that in the shown fully closed position ratchet 36 is engaged (refer also to FIG. 18) and that first plurality of teeth 38 mesh with second plurality of teeth 40. However, even in the closed position with ratchet 36 engaged, fabric 500 can prevent the teeth from meshing as is shown in FIG. 20. It is noted that in FIG. 11, the opposite side is the mirror image of that shown. In an embodiment, clip 20 has a length L of about 2.5 inches, however larger or smaller sizes can also be used as a function of user needs.

Figure 15:
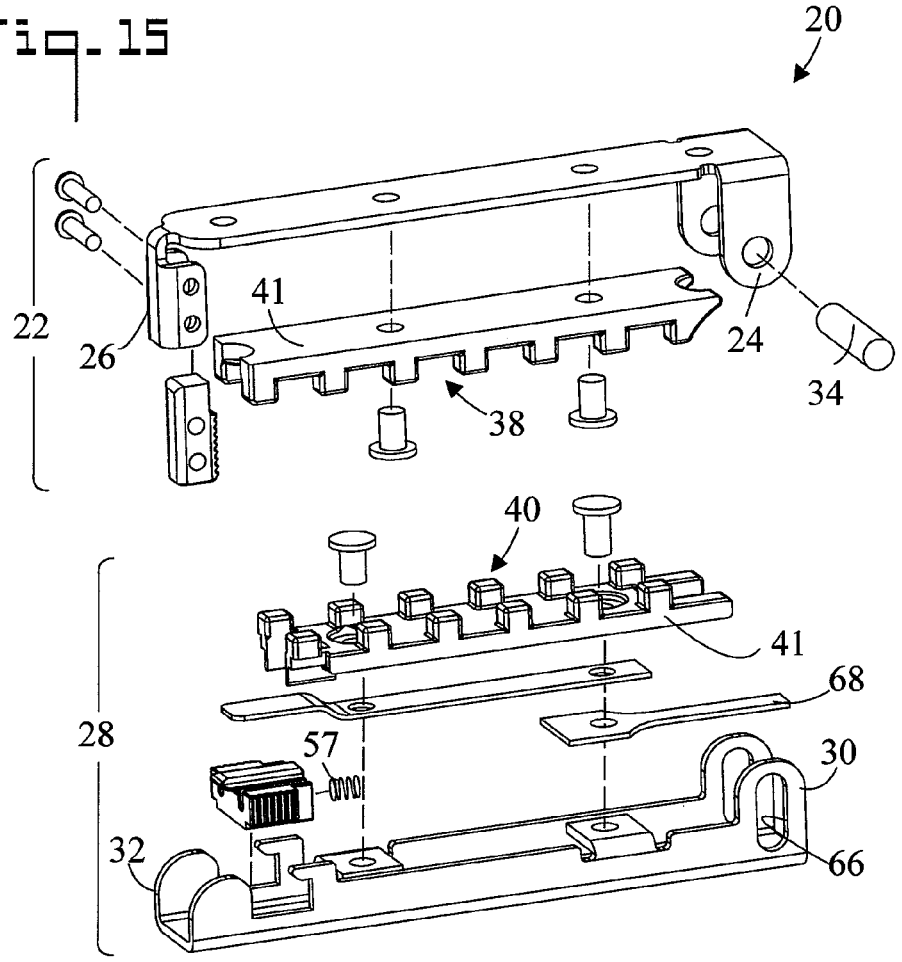
FIG. 15 is an exploded perspective view of the clip.

FIG. 15 is an exploded perspective view of clip 20, showing first jaw 22 having first end 24 and second end 26, second jaw 28 having first end 30 and second end 32, pivot pin 34, first plurality of teeth 38, second plurality of teeth 40, and two tooth plates 41. Other elements are also shown as is discussed below.

Figure 16:
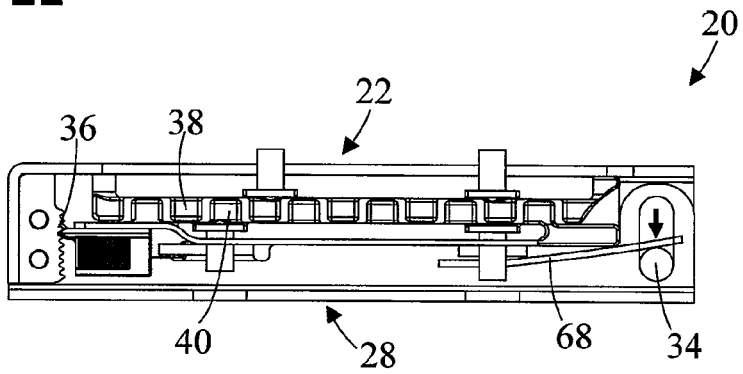
FIG. 16 is a cutaway side elevation view of the clip in the closed position.

FIG. 16 is a cutaway side elevation view of clip 20 in the closed position showing first jaw 22, second jaw 28, pivot pin 34, ratchet 36, first plurality of teeth 38, and second plurality of teeth 40.

Figure 17:
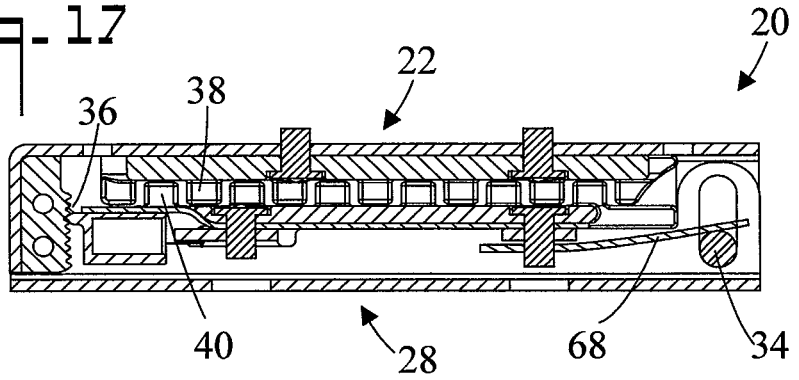
FIG. 17 is a cross sectional view of the clip along the line 17-17 of FIG. 10.

FIG. 17 is a cross sectional view of clip 20 along the line 17-17 of FIG. 10 showing first jaw 22, second jaw 28, pivot pin 34, ratchet 36, first plurality of teeth 38, and second plurality of teeth 40.

Figure 18:
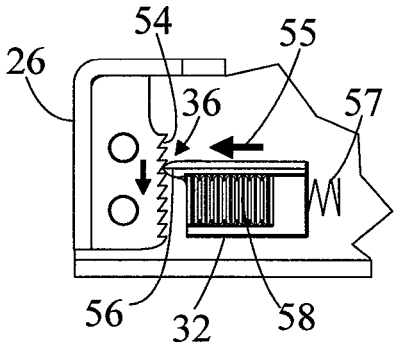
FIG. 18 is an enlarged fragmented cutaway view of area 18 of FIG. 11 showing a ratchet engaged.
Figure 19:
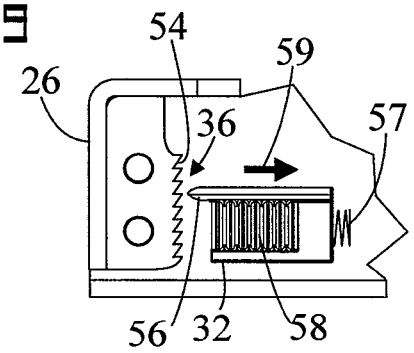
FIG. 19 is an enlarged fragmented cutaway view as in FIG. 18 showing the ratchet disengaged.

FIG. 18 is an enlarged fragmented cutaway view of area 18 of FIG. 11 showing ratchet 36 engaged, and FIG. 19 is an enlarged fragmented view as in FIG. 18 showing ratchet 36 disengaged. Ratchet 36 includes one of second end 26 of first jaw 22 and second end 32 of second jaw 28 having a toothed member 54 which has a plurality of teeth, and the other of second end 26 of first jaw 22 and the second end 32 of second jaw 28 having a pawl 56 which engages toothed member 54 when first 22 and second 28 jaws are in the closed position of FIG. 18. That is, toothed member 54 is either on second end 26 of first jaw 22 (as shown), or could be on second end 32 of second jaw 28, with pawl 56 being on the other jaw. Pawl 56 is biased by a spring 57 in direction 55 into contact with toothed member 54 (refer to FIG. 15). Ratchet 36 allows linear relative movement between toothed member 54 and pawl 56 in one direction (toothed member 54 moving down in the direction of the arrow as shown), but prevents motion in the opposite direction. As such, once pawl 56 engages the first tooth of toothed member 54, second end 26 of first jaw 22 is connected to second end 32 of second jaw 28, and the jaws are in the closed position. The jaws can only be moved back toward the open position by disengaging pawl 56 from toothed member 54 as is shown in FIG. 19. The disengagement is effected by manually activating pawl release 58 which overcomes the spring bias of spring 57 and moves pawl 56 in direction 59 and out of contact with toothed member 54.

FIG. 20 is a side elevation view showing clip 20 gripping a plurality of layers of fabric 500 as in FIG. 4. First end 24 of first jaw 22 and first end 30 of second jaw 28 combine to form a spreading mechanism 60 which causes first end 24 of first jaw 22 to spread apart from first end 30 of second jaw 28. That is, first end 24 of first jaw 22 and first end 30 of second jaw 28 linearly (not rotationally) move away from each other (spread apart) in the direction of arrows 62 and 64. Directions 62 and 64 are substantially perpendicular to the longitudinal axes 23 and 29 of first jaw 22 and second jaw 28 respectively when the jaws are in the closed position.

Figure 21:
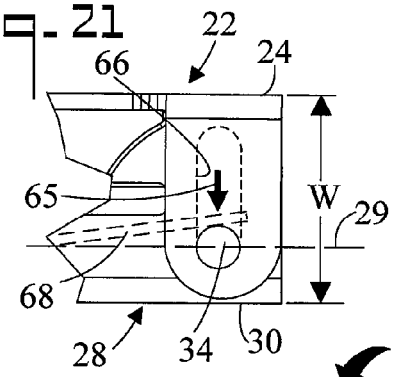
FIG. 21 is an enlarged fragmented view of area 21 of FIG. 11.

FIG. 21 is an enlarged fragmented view of area 21 of FIG. 11 showing first end 24 of first jaw 22 and first end 30 of second jaw 28 in an unspread position. Also referring to FIG. 15, spreading mechanism 60 includes (1) first end 24 of first jaw 22 having a pivot pin 34 (which in the shown embodiment is press fit into two holes in first end 24 of first jaw 22), (2) first end 30 of second jaw 28 having a slot 66 which slidably receives pivot pin 34, and (3) a biasing device which urges first end 24 of first jaw 22 and first end 30 of second jaw 28 together. In the shown embodiment the biasing device is a leaf spring 68 (refer also to FIGS. 1 and 15) which is connected to second jaw 28 and which abuts pivot pin 34 forcing pivot pin 34 (in the direction of the arrow 65) to one end of slot 66 (the lower end as shown). It is noted that direction 65 is substantially perpendicular to longitudinal axis 29 of second jaw 28. In other words, the biasing mechanism forces first end 24 of first jaw 22 and first end 30 of second jaw 28 together as is shown in FIG. 21. In this unspread position first jaw 22 and second jaw 28 have a width W. It is noted that while in the shown embodiment the biasing device is a leaf spring 68, it may be appreciated that with appropriate structural redesign, other biasing devices (such as a coil spring) could also be utilized to bias first ends 24 and 30 together.

Figure 23:
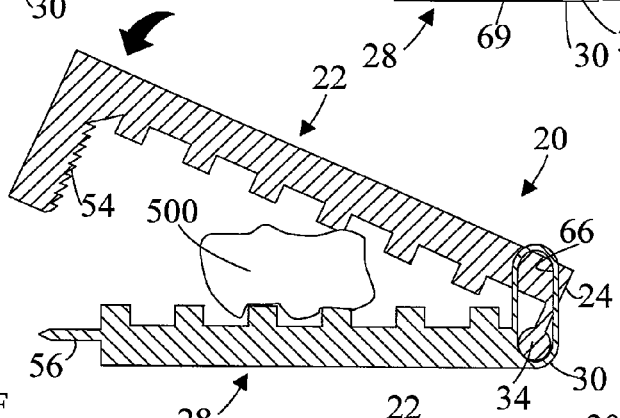
FIG. 23 is a functional diagram showing the clip in position to close on the fabric.
Figure 24:
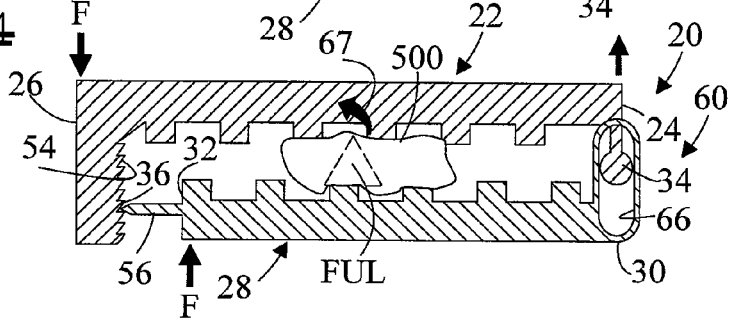
FIG. 24 is a functional diagram showing the clip closed on the fabric and the first ends of the first and second jaws spread apart.

Referring back to FIG. 20, when fabric 500 (multiple layers of fabric 500 as shown) is placed between first jaw 22 and second jaw 28 and a closing force F (a force which causes first ends 26 and 32 to move together engaging ratchet 36) is applied to second end 26 of first jaw 22 and second end 32 of second jaw 28, fabric 500 blocks closure of first jaw 22 with second jaw 28 thereby causing first end 26 of first jaw 22 to spread apart from first end 30 of second jaw 28 as closing force F is applied (also refer to FIGS. 23 and 24 and the associated discussions). This is because fabric 500 prevents first jaw 22 from closing with second jaw 28, and the only possible motion of jaws 22 and 28 in response to closing force F is spreading of the first ends 24 and 30. The spreading action of ends 24 and 30 ensures that the force applied by the jaws of clip 20 is evenly distributed across fabric 500. Conversely, if first ends 24 and 30 did not spread apart during closure of clip 20, more pressure would be applied to the gripped fabric 500 near pivot pin 34 resulting in possible cutting or other damage to fabric 500. It is also noted that as closing force F continues to be applied, toothed member 54 moves with respect to pawl 56 (downwardly as shown) to further engage ratchet 36, but is prevented from moving back in the opposite direction (refer also to FIG. 18 and the associated discussion).

Figure 22:
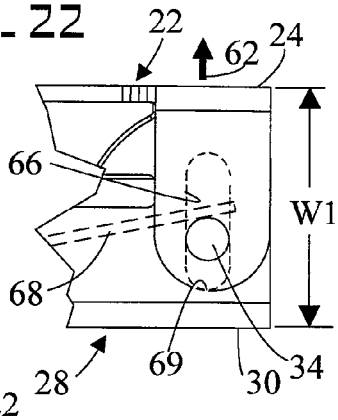
FIG. 22 is an enlarged fragmented view as in FIG. 21 showing the first ends of the first and second jaws spread apart.

FIG. 22 is an enlarged fragmented view as in FIG. 21 showing first ends 24 and 30 of first 22 and second 28 jaws spread apart as described above. Closing force F (refer to FIG. 20) causes first end 24 of first jaw 22 to linearly spread apart from first end 30 of second jaw 28 in direction 62. Closing force F overcomes biasing device 68 and results in pivot pin 34 moving in slot 66, and first end 24 of first jaw 22 spreading apart from first end 30 of second jaw 28. In this spread apart position first jaw 22 and second jaw 28 have a width W1, wherein spread width W1 is greater than unspread width W shown in FIG. 21. Slot 66 has a distal end 69 (refer to FIG. 22). In the unspread position of FIG. 21 pivot pin 34 abuts the distal end 69 of slot 66. It is noted that in the spread apart position of FIG. 22, pivot pin 34 moves away from the distal end 69 of slot 66 which it occupied in FIG. 21.

FIG. 23 is a functional diagram showing clip 20 in position to close on fabric 500, and FIG. 24 is a functional diagram showing clip 20 closed on fabric 500 and first ends 24 and 30 of first 22 and second 28 jaws respectively spread apart. Elements of first jaw 22 are shown with one direction cross hatching, and elements of second jaw 28 are shown with opposite direction cross hatching. In FIG. 23 first end 24 of first jaw 22 and first end 30 of second jaw 28 are in the unspread apart position (refer to FIG. 21), and pawl 56 is disengaged from toothed member 54. First jaw 22 and second jaw 28 are just starting to close on fabric 500. In this position pivot pin 34 is disposed at the bottom of slot 66 because of the action of biasing device 68 (refer to FIG. 21 and the associated discussion).

In FIG. 24 closing force F has been applied to second ends 26 and 32 causing ratchet 36 to engage thereby connecting second ends 26 and 32 together. As more closing force F is applied, fabric 500 compresses until it can compress no more. At this point fabric 500 effectively acts as a fulcrum FUL about which jaws 22 and 28 can relatively rotate, the rotation causing first ends 24 and 30 to spread apart. In the shown embodiment second jaw 28 is shown as stationary and first end 24 of first jaw 22 is shown rotating away from first end 30 of second jaw 28. First jaw 22 rotates about fulcrum FUL in direction 67. It is noted that the term "relatively rotate" means that the jaws rotate with respect to each other. This includes (1) first jaw 22 rotating away from a stationary second jaw 28 (as shown in FIG. 24), (2) second jaw 28 rotating away from a stationary first jaw, and (3) first jaw 22 and second jaw 28 both rotating away from each other.

In the above discussions of FIGS. 20-24 one specific spreading mechanism 60 has been disclosed. However, other spreading mechanisms 60 could also be utilized, so long as the mechanism allows the first ends of the jaws to spread apart when closing force F is applied, but otherwise resiliently urges the first ends of the jaws together. A useful feature of the spreading mechanism is that the biasing device 68 urges the first ends 26 and 32 of the jaws together. That biasing device 68 can be the shown leaf spring, a coil spring, or any other such device which accomplishes the urging together purpose.

Figure 25:
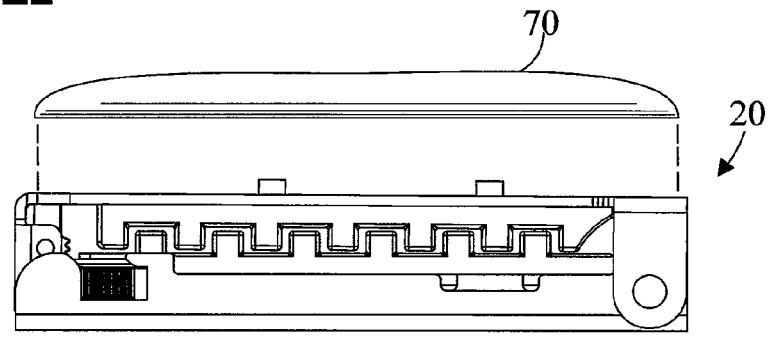
FIG. 25 is an exploded side elevation view of the clip and a decorative panel.
Figure 26:
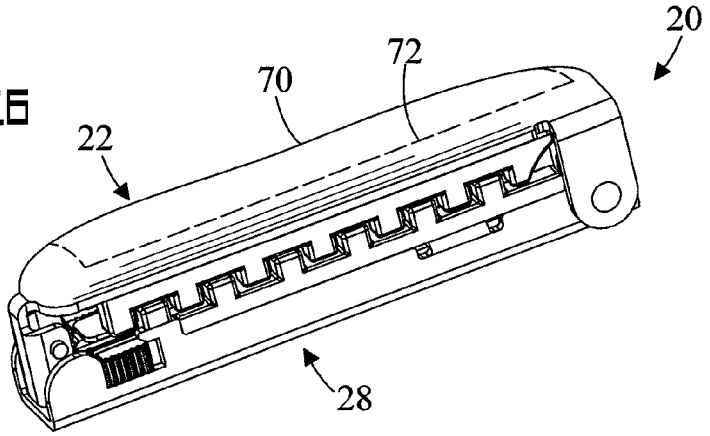
FIG. 26 is a perspective view of the clip with the decorative panel installed.

FIGS. 25 and 26 are exploded side elevation and perspective views respectively of clip 20 and a decorative panel 70. Optional decorative panel 70 includes decorations 72 such as ornaments, writing and/or patterns. Decorative panel 70 can include decorations 72 such as assorted ornamental jewelry embellishments, i.e., gemstones, rhinestones, crystals, beads, metals and other materials of the like that will provide a decorative aspect to the clip. It is also noted that decorative panel 70 can come in a variety of sizes and shapes ranging from the shown plain panel to larger and more ornate panels which overhang all sides of clip 20 and cover the body of the clip completely.

Figure 27:
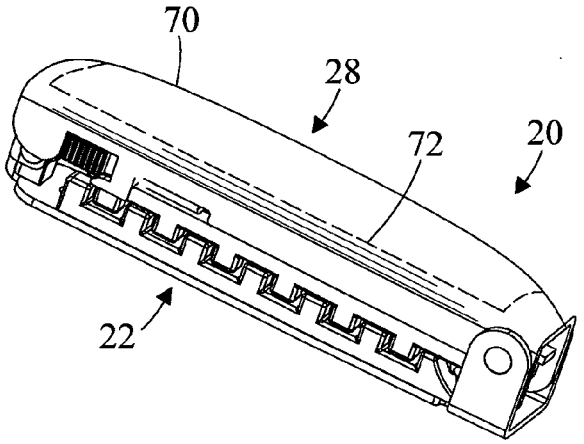
FIG. 27 is a perspective view of the clip in an inverted position with a decorative panel; and, FIG. 28 is a side elevation view showing another embodiment of the clip gripping the fabric.

FIG. 27 is a perspective view of clip 20 in an inverted position with decorative panel 70. It may be appreciated that clip may be used in either the position of FIG. 26 with first jaw 22 on top, or in the position of FIG. 27 with second jaw 28 on top. A decorative panel 70 and decorations 72 are also shown. Decorative panel 70 can be attached to either or both jaws of clip 20

Figure 28:
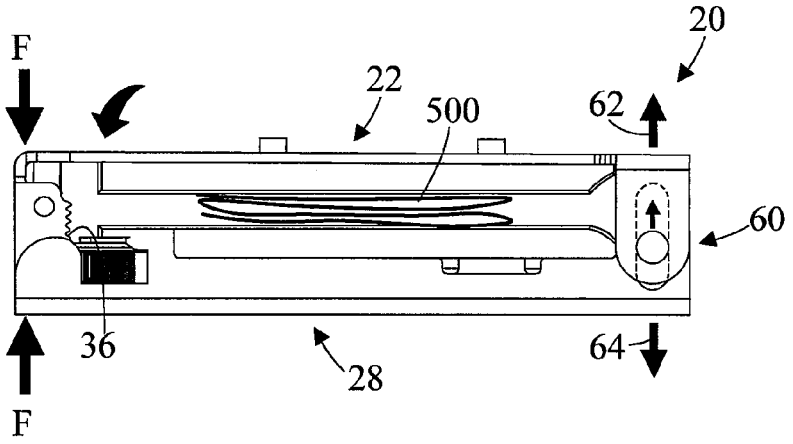

FIG. 28 is a side elevation view showing another embodiment of clip 20 gripping the fabric 500. In this embodiment first jaw 22 and second jaw 28 do not have teeth, but rather have flat surfaces which clamp down and grip fabric 500. Otherwise the operation of the embodiment of FIG. 28 is the same as that previously described for the embodiment of FIGS. 1-27.

In another embodiment, of clip 20 and fabric 500 combine to form a fabric fastening system.

In terms of use, a method for fastening fabric includes: (refer to FIGS. 1-28)

(a) providing an article of fabric 500;

(b) providing a clip 20 for the article of fabric 500, including;

a first jaw 22 having a first end 24 and an opposite second end 26;

a second jaw 28 having a first end 30 and an, opposite second end 32, first end 30 of second jaw 28 pivotally connected to first end 26 of first jaw 22;

first 22 and second 28 jaws rotatably positionable to an open position and to a closed position;

first end 26 of first jaw 22 and first end 30 of second jaw 28 forming a spreading mechanism which causes first end 26 of first jaw 22 to spread apart from first end 30 of second jaw 28;

second end 26 of first jaw 22 and second end 32 of second jaw 28 forming a ratchet 36 which in the closed position connects second end 26 of first jaw 22 to second end 32 of second jaw 28;

(c) placing first 22 and second 28 jaws in the open position;

(d) placing article of fabric 500 between first jaw 22 and second jaw 28; and, (e) applying a closing force F to second end 26 of first jaw 22 and second end 32 of second jaw 28 to place first jaw 22 and second jaw 28 in the closed position.

The method further including:

in (e), article of fabric 500 blocking closure of first jaw 22 with second jaw 28 thereby causing first end 24 of first jaw 22 to spread apart from first end 30 of second jaw 28 when closing force F is applied.

The method further including:

in (b), ratchet 36 including one of second end 26 of first jaw 22 and second end 32 of second jaw 28 having a toothed member 54, and the other of second end 26 of first jaw 22 and second end 32 of second jaw 28 having a pawl 56 which engages toothed member 54 when first 22 and second 28 jaws are in the closed position of (e);

in (b), providing a pawl release 58 for disengaging ratchet 36; and, after (e), using pawl release 58 to disengage ratchet 36.

The embodiments of the clip and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the clip and method should be construed as limiting the invention to a particular embodiment or combination of embodiments. The scope of the invention is defined by the appended claims.

I claim:

1. A clip for fabric comprising:

a first jaw having a first end and an opposite second end;

a second jaw having a first end and an opposite second end, said first end of said second jaw pivotally connected to said first end of said first jaw;

said first and second jaws positionable to an open position and to a closed position;

a spreading mechanism which causes said first end of said first jaw to linearly spread apart from said first end of said second jaw;

said spreading mechanism including (1) said first end of said first jaw having a pivot pin, (2) said first end of said second jaw having a slot which receives said pivot pin, said slot having a distal end, and (3) a biasing device which urges said first end of said first jaw and said first end of said second jaw linearly together;

said jaws having an unspread position and a spread apart position;

in said unspread position said biasing device forcing said pivot pin to abut said distal end of said slot;

in said spread apart position said pivot pin moves away from said distal end of said slot; and, said second end of said first jaw and said second end of said second jaw forming a ratchet which engages in said closed position and connects said second end of said first jaw to said second end of said second jaw, said ratchet including a toothed member which has a plurality of teeth.

2. The clip according to claim 1, further including:

said first jaw having a longitudinal axis and said second jaw having a longitudinal axis; and, said spreading mechanism including a biasing device which urges said first end of said first jaw and said first end of said second jaw linearly together in a direction which is substantially perpendicular to said longitudinal axis of said second jaw.

3. The clip according to claim 1, further including:

when the fabric is placed between said first jaw and said second jaw and a closing force is applied to said second end of said first jaw and said second end of said second jaw, said spreading mechanism causes said first jaw and said second jaw to relatively rotate and said first end of said first jaw to linearly spread apart from said first end of said second jaw.

4. The clip according to claim 1, further including;

said spreading mechanism ensuring that a force applied by said first jaw and said second jaw to the fabric is evenly distributed across the fabric.

5. The clip according to claim 1, further including:

said first jaw having a longitudinal axes and said second jaw having a longitudinal axis; and, said first end of said first jaw linearly spreading apart from said first end of said second jaw in a direction which is substantially perpendicular to said longitudinal axes of said first and second jaws.

6. The clip according to claim 1, further including:

said first jaw having a first plurality of teeth and said second jaw having a second plurality of teeth, said first plurality of teeth and said second plurality of teeth for gripping the fabric therebetween;

said first jaw having a longitudinal axes and said second jaw having a longitudinal axis;

said first plurality of teeth of said first jaw including a first row of teeth and a second row of teeth separated by a first cavity which extends along said longitudinal axis of said first jaw; and, said second plurality of teeth of said second jaw including a first row of teeth and a second row of teeth separated by a second cavity which extends along said longitudinal axis of said second jaw.

7. The clip according to claim 3, further including:

the fabric acting as a fulcrum about which said first jaw and said second jaw relatively rotate.

8. The clip according to claim 1, further including:

said ratchet including one of said second end of said first jaw and said second end of said second jaw having said toothed member, and the other of said second end of said first jaw and said second end of said second jaw having a pawl which engages said toothed member when said first and second jaws are in said closed position; and, said ratchet allowing linear relative movement between said toothed member and said pawl in one direction, but preventing motion in the opposite direction.

9. The clip according to claim 8, further including:

a pawl release for disengaging said pawl from said toothed member.

10. The clip according to claim 1, further including:

said first jaw having a longitudinal axis and said second jaw having a longitudinal axis;

said spreading mechanism including a biasing device which urges said first end of said first jaw and said first end of said second jaw linearly together in a direction which is substantially perpendicular to said longitudinal axis of said second jaw;

when the fabric is placed between said first jaw and said second jaw and a closing force is applied to said second end of said first jaw and said second end of said second jaw, said spreading mechanism causes said first jaw and said second jaw to relatively rotate and said first end of said first jaw to linearly spread apart from said first end of said second jaw;

said spreading mechanism ensuring that a force applied by said first jaw and said second jaw to the fabric is evenly distributed across the fabric;

said first jaw having a longitudinal axes and said second jaw having a longitudinal axis;

said first end of said first jaw spreading apart from said first end of said second jaw in a direction which is substantially perpendicular to said longitudinal axes of said first and second jaws;

said ratchet including one of said second end of said first jaw and said second end of said second jaw having said toothed member, and the other of said second end of said first jaw and said second end of said second jaw having a pawl which engages said toothed member when said first and second jaws are in said closed position;

said ratchet allowing linear relative movement between said toothed member and said pawl in one direction, but preventing motion in the opposite direction;

a pawl release for disengaging said pawl from said toothed member; and, the fabric acting as a fulcrum about which said first jaw and said second jaw relatively rotate.

11. A fabric fastening system, comprising:

an article of fabric;

a clip for said article of fabric including;

a first jaw having a first end and an opposite second end;

a second jaw having a first end and an opposite second end, said first end of said second jaw pivotally connected to said first end of said first jaw;

said first and second jaws positionable to an open position and to a closed position;

a spreading mechanism which causes said first end of said first jaw to linearly spread apart from said first end of said second jaw;

said spreading mechanism including (1) said first end of said first jaw having a pivot pin, (2) said first end of said second jaw having a slot which receives said pivot pin, said slot having a distal end, and (3) a biasing device which urges said first end of said first jaw and said first end of said second jaw linearly together;

said jaws having an unspread position and a spread apart position;

in said unspread position said biasing device forcing said pivot in to abut said distal end of said slot;

in said spread apart position said pivot pin moves away from said distal end of said slot;

said second end of said first jaw and said second end of said second jaw forming a ratchet which engages in said closed position and connects said second end of said first jaw to said second end of said second jaw, said ratchet including a toothed member which has a plurality of teeth; and, said first and second jaws designed to clamp two or more layers of said article of fabric together.

12. The system according to claim 11, further including:

said first jaw having a longitudinal axis and said second jaw having a longitudinal axis; and, said spreading mechanism including a biasing device which urges said first end of said first jaw and said first end of said second jaw linearly together in a direction which is substantially perpendicular to said longitudinal axis of said second jaw.

13. The system according to claim 11, further including:

when multiple layers of said fabric are placed between said first jaw and said second jaw and a closing force is applied to said second end of said first jaw and said second end of said second jaw, said spreading mechanism causes said first jaw and said second jaw to relatively rotate and said first end of said first jaw to linearly spread apart from said first end of said second jaw.

14. The system according to claim 11, further including;

said spreading mechanism ensuring that a force applied by said first jaw and said second jaw to said article of fabric is evenly distributed across said article of fabric.

15. The system according to claim 11, further including:

said first jaw having a first plurality of teeth and said second jaw having a second plurality of teeth, said first plurality of teeth and said second plurality of teeth for gripping the fabric therebetween;

said first jaw having a longitudinal axes and said second jaw having a longitudinal axis;

said first plurality of teeth of said first jaw including a first row of teeth and a second row of teeth separated by a first cavity which extends along said longitudinal axis of said first jaw; and, said second plurality of teeth of said second jaw including a first row of teeth and a second row of teeth separated by a second cavity which extends along said longitudinal axis of said second jaw.

16. The system according to claim 11, further including:

said ratchet including one of said second end of said first jaw and said second end of said second jaw having said toothed member, and the other of said second end of said first jaw and said second end of said second jaw having a pawl which engages said toothed member when said first and second jaws are in said closed position; and, said ratchet allowing linear relative movement between said toothed member and said pawl in one direction, but preventing motion in the opposite direction.

17. The system according to claim 11, further including:

said first jaw having a longitudinal axes and said second jaw having a longitudinal axis; and, said first end of said first jaw linearly spreading apart from said first end of said second jaw in a direction which is substantially perpendicular to said longitudinal axes of said first and second jaws.

18. A clip for fabric comprising:

a first jaw having a first end and an opposite second end;

a second jaw having a first end and an opposite second end, said first end of said second jaw pivotally connected to said first end of said first jaw;

said first and second jaws positionable to an open position and to a closed position;

a spreading mechanism which causes said first end of said first jaw to spread apart from said first end of said second jaw;

said spreading mechanism including (1) said first end of said first jaw having a pivot pin, (2) said first end of said second jaw having a slot which receives said pivot pin, said slot having a distal end;

said jaws having an unspread position and a spread apart position;

in said unspread position said pivot pin abuts said distal end of said slot;

in said spread apart position said pivot pin moves away from said distal end of said slot; and, said second end of said first jaw and said second end of said second jaw forming a ratchet which engages in said closed position and connects said second end of said first jaw to said second end of said second jaw, said ratchet including a toothed member which has a plurality of teeth.

19. A method for gripping fabric, comprising:

(a) providing an article of fabric;

(b) providing a clip for said article of fabric, including;

a first jaw having a first end and an opposite second end;

a second jaw having a first end and an opposite second end, said first end of said second jaw pivotally connected to said first end of said first jaw;

said first and second jaws rotatably positionable to an open position and to a closed position;

said first end of said first jaw and said first end of said second jaw forming a spreading mechanism which allows said first end of said first jaw to spread apart from said first end of said second jaw;

said spreading mechanism including (1) said first end of said first jaw having a pivot pin, (2) said first end of said second jaw having a slot which receives said pivot pin, said slot having a distal end;

said jaws having an unspread position and a spread apart position;

in said unspread position said pivot pin abuts said distal end of said slot;

in said spread apart position said pivot pin moves away from said distal end of said slot;

said second end of said first jaw and said second end of said second jaw forming a ratchet which in said closed position connects said second end of said first jaw to said second end of said second jaw;

(c) placing said first and second jaws in said open position;

(d) placing said article of fabric between said first jaw and said second jaw; and, (e) applying a closing force to said second end of said first jaw and said second end of said second jaw to place said first jaw and said second jaw in said closed position.

20. The method of claim 19, further including:

in (e), said article of fabric blocking closure of said first jaw with said second jaw thereby causing said first end of said first jaw to spread apart from said first end of said second jaw when said closing force is applied.

21. The method of claim 20, further including:

in (b), said ratchet including one of said second end of said first jaw and said second end of said second jaw having a toothed member, and the other of said second end of said first jaw and said second end of said second jaw having a pawl which engages said toothed member when said first and second jaws are in said closed position of (e);

in (b), providing a pawl release for disengaging said ratchet; and, after (e), using said pawl release to disengage said ratchet.

* * * * *